US006237505B1

(12) United States Patent
Sande et al.

(10) Patent No.: US 6,237,505 B1
(45) Date of Patent: May 29, 2001

(54) LARGE CAPACITY CAR BODY FOR PRESSURE DISCHARGE RAILWAY HOPPER CARS

(75) Inventors: Jerry W. Vande Sande, Colleyville; Stephen W. Smith, Dallas, both of TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/295,237

(22) Filed: Apr. 19, 1999

Related U.S. Application Data

(60) Provisional application No. 60/082,702, filed on Apr. 22, 1998, and provisional application No. 60/082,701, filed on Apr. 22, 1998.

(51) Int. Cl.[7] ..... B61D 7/00

(52) U.S. Cl. ..... 105/248; 105/247; 52/45; 52/47; 52/50; 52/51; 52/52

(58) Field of Search ..... 105/248, 247, 105/358, 360; 52/45, 47, 50, 51, 52

(56) References Cited

U.S. PATENT DOCUMENTS

| | | | |
|---|---|---|---|
| 1,422,133 | 7/1922 | Robider . | |
| 2,089,347 | 8/1937 | Dondlinger | 214/83 |
| 2,274,708 | 3/1942 | Kennedy | 302/53 |

(List continued on next page.)

FOREIGN PATENT DOCUMENTS

| | | | |
|---|---|---|---|
| 844874 | 6/1970 | (CA) | 105/123 |
| 1015007 | 8/1977 | (CA) | 302/33 |
| 1101021 | 5/1981 | (CA) | 302/17 |
| 1149230 | 7/1983 | (CA) | 105/123 |
| 1156513 | 11/1983 | (CA) | 105/123 |
| 1165182 | 4/1984 | (CA) | 105/123 |
| 1174114 | 9/1984 | (CA) | 105/122 |
| 3402895A1 | 8/1984 | (DE) | B65G/67/24 |

OTHER PUBLICATIONS

North American Car Corp. brochure, "The Unique Car, A Totally Flexible Distribution System for Dry Flowable Products.", No date.

Trinity Industries, Inc. Operating brochure, "Power Flow" (PF/RSB–3M–6/88), 1988.

Solimar brohcure, "Pneumatic Systems for Dry Bulk Trailers, Railway Cars and Storage Silos", No date.

(List continued on next page.)

*Primary Examiner*—S. Joseph Morano
*Assistant Examiner*—Lars A. Olson
(74) *Attorney, Agent, or Firm*—Baker Botts L.L.P.

(57) ABSTRACT

A large capacity car body for a pressure discharge railway hopper car has a plurality of end slope plates assemblies, each having a slope sheet, and a plurality of intermediate slope sheet units, each of inverted "V" shape. The intermediate slope sheet units and the end slope plates form the end walls of a plurality of hoppers. A crossridge frame is associated with each of the intermediate slope sheet units and together with the end frames supports side sheets and a top sheet. Top chord members and bottom chord members extend coextensively with and are welded to upper and lower edge portions of each side sheet. Edge portions of the top sheet overlap and are welded to upper leg portions of the two top chord members. The crossridge frames and chord members considerably increase the resistance of the side sheets and top sheet to deforming when the car body is pressurized during unloading. The sides and the top of the of the car body are curved in end profile, the sides having radii of about eleven feet and the top a radius of about seven feet. The overall width of the car is about ten feet, eight inches, and the top sheet has a span of about eight feet, five inches. The curvatures of the side and top sheets and the overall dimensions provide the car body with added capacity in the upper and lower corners, as compared with a car body having a substantially circular cylindrical end profile.

21 Claims, 5 Drawing Sheets

U.S. PATENT DOCUMENTS

| | | | | |
|---|---|---|---|---|
| 2,950,143 | | 8/1960 | Koranda et al. | 302/52 |
| 3,066,621 | * | 12/1962 | Dean et al. | 52/51 |
| 3,088,776 | | 5/1963 | Aller | 302/52 |
| 3,177,042 | | 4/1965 | Borger et al. | 302/58 |
| 3,252,431 | | 5/1966 | Phillips | 105/360 |
| 3,339,499 | * | 9/1967 | Charles et al. | 105/248 |
| 3,343,888 | | 9/1967 | Anderson et al. | 302/52 |
| 3,420,419 | | 1/1969 | Haslett, Jr. | 222/544 |
| 3,583,330 | | 6/1971 | Freudman et al. | 105/239 |
| 3,583,331 | * | 6/1971 | Mowatt-Larssen | 105/360 |
| 3,639,007 | | 2/1972 | Dare et al. | 302/52 |
| 3,708,209 | | 1/1973 | Dugge | 302/52 |
| 3,778,114 | | 12/1973 | Carney et al. | 302/52 |
| 3,837,497 | | 9/1974 | Smith | 210/349 |
| 3,929,261 | | 12/1975 | Solimar | 222/195 |
| 4,082,365 | | 4/1978 | Dugge et al. | 302/52 |
| 4,101,175 | | 7/1978 | Kull | 302/53 |
| 4,106,749 | | 8/1978 | Behle | 351/144 |
| 4,151,935 | | 5/1979 | Dugge | 222/556 |
| 4,165,820 | | 8/1979 | Dugge et al. | 222/70 |
| 4,189,262 | | 2/1980 | Anderson | 406/136 |
| 4,194,450 | | 3/1980 | Miller | 105/253 |
| 4,227,732 | | 10/1980 | Kish | 294/71 |
| 4,254,714 | | 3/1981 | Heap | 105/406 R |
| 4,280,706 | | 7/1981 | Vorwerk | 277/12 |
| 4,286,524 | | 9/1981 | Jantzen | 105/248 |
| 4,352,331 | | 10/1982 | Anderson et al. | 105/248 |
| 4,353,560 | | 10/1982 | Tohill | 277/236 |
| 4,353,668 | | 10/1982 | Anderson | 406/90 |
| 4,360,295 | | 11/1982 | Anderson | 406/76 |
| 4,361,096 | | 11/1982 | Funk | 105/248 |
| 4,362,111 | * | 12/1982 | Stark et al. | 105/247 |
| 4,384,730 | | 5/1983 | Diehl | 277/236 |
| 4,428,585 | | 1/1984 | Dugge | 277/12 |
| 4,444,123 | * | 4/1984 | Smith et al. | 52/46 |
| 4,455,947 | * | 6/1984 | Reeve et al. | 52/45 |
| 4,466,558 | | 8/1984 | Dugge et al. | 222/195 |
| 4,484,528 | | 11/1984 | Anderson et al. | 105/248 |
| 4,484,852 | | 11/1984 | Anderson | 414/525 |
| 4,498,400 | | 2/1985 | Vorwerk et al. | 105/248 |
| 4,568,224 | | 2/1986 | Dugge et al. | 406/90 |
| 4,594,948 | | 6/1986 | Smith et al. | 105/359 |
| 4,598,646 | * | 7/1986 | Dugge et al. | 105/248 |
| 4,617,868 | | 10/1986 | Wahlstrom et al. | 105/282 |
| 4,644,871 | | 2/1987 | Arrey et al. | 105/4 |
| 4,662,543 | | 5/1987 | Solimar | 222/195 |
| 4,677,917 | | 7/1987 | Dugge et al. | 105/248 |
| 4,718,795 | | 1/1988 | Dugge | 406/30 |
| 4,768,684 | | 9/1988 | Dugge | 222/542 |
| 4,846,377 | | 7/1989 | Fix et al. | 222/195 |
| 4,867,073 | | 9/1989 | Dugge | 105/358 |
| 4,880,148 | | 11/1989 | Schmidt | 222/195 |
| 4,884,511 | | 12/1989 | Hallam et al. | 105/247 |
| 4,884,723 | | 12/1989 | Dugge | 222/542 |
| 4,898,101 | | 2/1990 | Harter | 105/247 |
| 4,902,215 | | 2/1990 | Seemann, III | 425/406 |
| 5,000,358 | | 3/1991 | Dugge | 222/502 |
| 5,052,906 | | 10/1991 | Seemann | 425/112 |
| 5,073,259 | | 12/1991 | Solimar | 210/232 |
| 5,139,175 | | 8/1992 | Krysel et al. | 222/195 |
| 5,236,287 | | 8/1993 | Dugge et al. | 406/145 |
| 5,238,333 | | 8/1993 | Dugge et al. | 406/145 |
| 5,248,227 | | 9/1993 | Hidock et al. | 406/41 |
| 5,259,322 | | 11/1993 | Dominguez et al. | 105/4.1 |
| 5,263,421 | | 11/1993 | Lichey et al. | 105/248 |
| 5,316,462 | | 5/1994 | Seemann | 425/112 |
| 5,355,809 | | 10/1994 | Dugge | 105/424 |
| 5,400,718 | | 3/1995 | Theurer et al. | 105/239 |
| 5,433,559 | * | 7/1995 | Vande Sande | 105/248 |
| 5,657,700 | | 8/1997 | Bounds | 105/311.1 |

OTHER PUBLICATIONS

ACF Shippers Car Line Div., Operating & Service Manual, "Center Flow Pressureaide, Pressure Differential Car." 1962 ACF Industries, Inc., 1982.

GATX Operating Manual, "Power–Flo", No date.

AAA Manual of Standards and Recommended Practices, Section C, Car Construction Fundamentals and Details, 1979.

Patent application USSN 60/125,371 filed Mar. 18, 1999 entitled "*Aerator Pad Assembly for Raiilway Hopper Cars*" (Attorney's docket: 091078.0798), 1999.

Patent application USSN 60/082,701 Apr. 22, 1998, "*Pressure Discharge Railway Hopper Car*." (Attorney's docket: 091078.0621), 1999.

Trademark Power Flo, Reg. No. 1,543,426, registered Jun. 13, 1989.

* cited by examiner

LARGE CAPACITY CAR BODY FOR PRESSURE DISCHARGE RAILWAY HOPPER CARS

RELATED APPLICATIONS

This application claims the benefit of U.S. Provisional Application Ser. No. 60/082,702 filed Apr. 22, 1998, and U.S. Provisional Application Ser. No. 60/082,701 filed Apr. 22, 1998.

This application is related to copending U.S. patent application Ser. No. 09/294,728 entitled *Pressure Discharge Railway Hopper Car*, filed , Apr. 19, 1999, and related to copending U.S. patent application Ser. No. 09/528,208 entitled *Aerator Pad Assembly for Railway Hopper Cars*, filed Mar. 17, 2000.

TECHNICAL FIELD OF THE INVENTION

The present invention relates generally to railway hopper cars and, more particularly, to a large capacity car body for pressure discharge railway hopper cars.

BACKGROUND OF THE INVENTION

Closed railway hopper cars with pneumatic systems for unloading them are well known and widely used for the transportation of powdered and granular products. For cars with positive pressure pneumatic systems, air is supplied from an external source to pressurize the interior of the car body and simultaneously fluidize the dry, bulk product carried within the car to enable it to be conveyed in a fluidized state by air flow through product discharge conduits from the car. An air pressure of about fifteen psi gage may be maintained within the hopper car during the unloading procedure. Ordinarily, the pneumatic discharge or unloading system associated with a pressure discharge railway hopper car includes an air supply conduit for directing a portion of the air supplied to the hopper car directly into the discharge conduit or line. The air pressure in the discharge line is generally maintained at two or three psi below the pressure within the hopper car.

Trinity Industries, Inc., the assignee of the present invention, manufactures and sells Power Flo® pressure discharge railway cars with pneumatic unloading systems. An example of aeration equipment and a pneumatic discharge system for removing dry, bulk material from hopper style containers is described and shown in U.S. Pat. No. 3,929,261 entitled *Aeration Device and Method for Assisting Discharge of Material from Containers.*

Flour, starch, and similar powdery food products are examples of dry, bulk material suited for loading, transportation and discharge with an enclosed hopper car having a positive pressure pneumatic unloading system. Any dry powder, granular, or pellet-type product may, usually to advantage, be transported in such hopper cars. An enclosed hopper car in cooperation with the pneumatic system protects the contents of the car and minimizes product losses during loading, transportation, and discharge processes. Also, pneumatic transfer is often the most cost effective, efficient method for handling large quantities of dry, bulk fluent materials.

Except for a spherical vessel, which is impractical and not necessary for the relatively low pressure involved, a generally cylindrical vessel is often the most efficient form for the body of a pressure discharge railway hopper car. The generally cylindrical wall of such a vessel is typically self-supporting with respect to forces due to internal pressure, which tend to produce uniform circumferential tensile stresses in portions of the cylindrical wall. A normal requirement for such containers is that the cylindrical wall be sufficiently thick to endure the tensile stress. A generally cylindrical shape is also effective in carrying its own load and the load of the product it contains, although supplementary longitudinally extending, vertical load-carrying members are often desirable, and usually necessary, to prevent buckling of the tank.

A disadvantage of a generally cylindrical car body for a pressure discharge railway hopper car is that it often does not effectively use the available AAR Plate "C" boundaries, which in end profile are essentially rectangular, except for small triangular cut-away areas in each corner. From the point of view of maximizing load carrying capacity, a car with an end profile approximating the AAR Plate "C" rectangle is desirable. Such a car would have flat sides and a flat roof, but it would require thicker wall plates and numerous side and roof stiffeners to keep the side and top walls from deforming, thus considerably increasing the costs of manufacturing parts and of assembling the car.

SUMMARY OF THE INVENTION

Accordingly, a need has arisen in the art for an improved large capacity car body for pressure discharge railway hopper cars. The present invention provides a large capacity car body for pressure discharge railway hopper cars that substantially eliminates or reduces problems associated with prior car bodies for railway hopper cars.

One aspect of the present invention is to provide a pressure discharge hopper car having a greater capacity than previously known hopper cars of comparable size and type. Another aspect is to reduce the costs of designing, producing parts for, and assembling pressure discharge railway cars. A further aspect is to add load carrying capacity for a given AAR profile without unduly increasing manufacturing costs, avoid increasing aerodynamic drag, and retain an interior which may be readily fully emptied and easy to clean and maintain.

The aforementioned are attained, in accordance with teachings of the present invention, by a large capacity car body for a pressure discharge railway hopper car that forms a chamber and may include end slope sheets, and a plurality of intermediate slope sheet units, each of inverted "V" shape. The intermediate slope sheet units and the end slope plates form the end walls of a plurality of hoppers in the lower portion of the car body. A side sheet may form each side of the car body, attached to each of the intermediate slope sheet units and to the end assemblies. Each side sheet preferably has a uniform convex curvature outwardly with respect to the interior chamber in end profile along its length. A top sheet forms a top of the car body and is attached to the end assemblies. The top sheet preferably has a uniform convex curvature outwardly with respect to the interior chamber in end profile along its length. An upper edge portion of each side sheet may form an obtuse included angle with a side edge portion of the top sheet.

A crossridge frame may be associated with each of the intermediate slope sheet units. Each crossridge frame preferably has an upwardly extending side stiffener rib attached to each end of the intermediate slope sheet unit and to each of the side sheets, each side stiffener rib being curved to match the curvature of the side sheet, and a top stiffener rib extending between the upper ends of the side stiffener ribs and attached to the top sheet, the top stiffener rib being curved to match the curvature of the top sheet. A corner connector preferably joins an upper end portion of each side stiffener rib to an end portion of the top stiffener rib. Each corner connector may have a side arm portion engaging and fastened to the upper end portion of the side stiffener rib, a top arm portion engaging and fastened to the end portion of the top stiffener rib, and a juncture portion joining the side arm portion and top arm portion at an angle corresponding to the obtuse angle between the upper edge of each side sheet and the side edge of the top sheet.

The arrangement of the side sheets and top sheet with an obtuse angle between them makes it possible to use more of the upper corner portions of the AAR Plate "C" end profile, thus increasing the capacity of the car body, as compared with a car having a nearly cylindrical end profile. The forming of each crossridge frame from two curved side members, a curved top member, and corner connectors, simplifies manufacture by eliminating complicated and time-consuming welding operations, especially at the corner junctures. The connectors ensure the accuracy and required strength at the corner junctures.

Although other smooth curvatures are possible, in one embodiment of the present invention the side stiffener ribs and side sheets are preferably substantially arcuate in end profile and have a first radius. The top stiffener ribs and top sheet are substantially arcuate in end profile and have a second radius. The first radius is preferably substantially greater than the second radius. For one application, the first radius may be about eleven feet and the second radius about seven feet. The lateral extremities of the associated side sheets may be spaced apart by about ten feet, eight inches. The top sheet may have a span of about eight feet, five inches. The first and second radius and the other dimensions cooperate with each other to add capacity in the upper and lower corners, as compared to a typical cylindrical end profile.

Each crossridge frame may also include a center column extending vertically between and joined at the bottom to the intermediate slope sheet unit and at the top to the top stiffener rib. The corner connectors of the crossridge frames may be metal castings. The side stiffener ribs and top stiffener rib are, preferably hat-shaped in cross section, each including a channel-shaped portion and side flange portions, and the corner connectors nest in the channel-shaped portions and have outer surfaces flush with outer surfaces of the side flange portions of the stiffener ribs.

Further features of preferred embodiments of the car body may include a top chord member extending substantially coextensively with an upper edge portion of each side sheet, the top chord member having a channel-shaped portion that overlies the side sheet, a lower leg portion of which is welded along its entire length to the side sheet. A top leg portion extends from the channel-shaped portion of the top chord member is preferably bent to conform to and engage the juncture portion of the corner connector and may be welded to the corner connector. Also, the outer surface of each corner connector preferably includes a first offset surface between the side arm portion and the top arm portion that is substantially flush with the associated side sheet, and is overlapped by part of the upper leg portion of the top chord member and a second offset surface that is substantially flush with an end part of the top leg portion of the top chord member. Edge portions of the top sheet overlap edge portions of the top leg portions of the top chord member on each side of the car. The edges of the top sheet may be welded to the top leg portions of the top chord members along their entire length. The corner structure provides an excellent tie-in between the top chords, the side sheets, the crossridge frames and the roof sheet at the corner junctures.

The car body preferably has a bottom chord member extending substantially coextensively with a lower edge portion of each side sheet. Each bottom chord member preferably includes a channel-shaped portion that overlies the side sheet and has a lower leg portion that is welded along its entire length to the side sheet. Each bottom chord member may also have a top flange portion welded to the side sheet. Each bottom chord member and lower edge portion of each side sheet are preferably positioned laterally outwardly of upper edge portions of the intermediate slope sheet units.

BRIEF DESCRIPTION OF THE DRAWINGS

For a more complete understanding of the present invention, and the advantages thereof, reference may be made to the following written description of an exemplary embodiment, taken in conjunction with the accompanying drawings, in which.

DESCRIPTION OF THE EMBODIMENTS

Preferred embodiments of the present invention and its advantages are best understood by referring to FIGS. 1–12 of the drawings, like numerals being used for like and corresponding parts of the various Figures.

Figure 1:
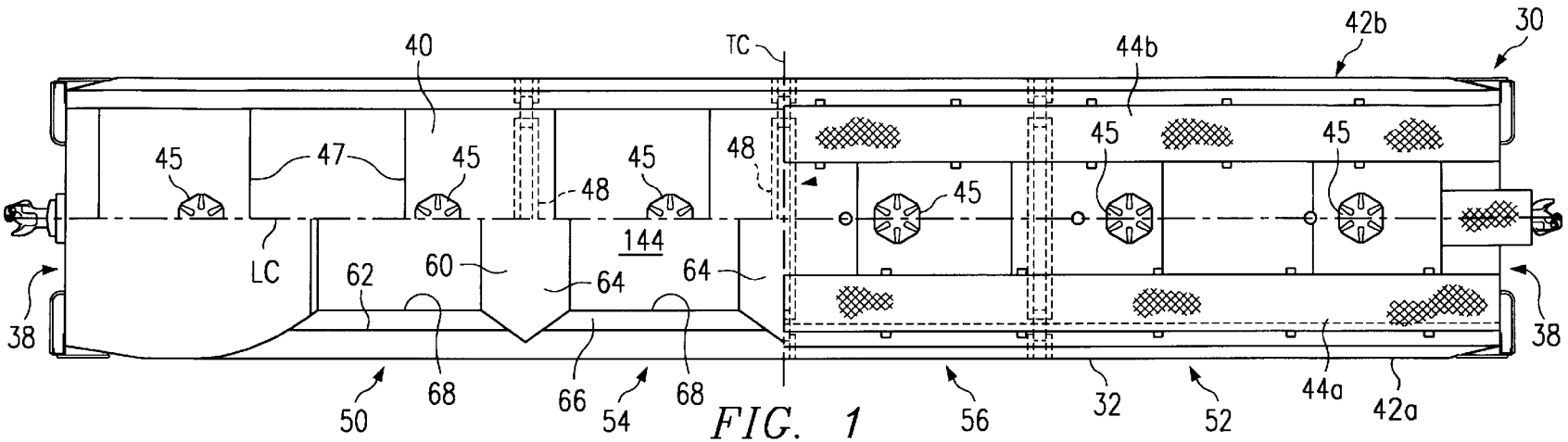
FIG. 1 is a schematic drawing, with portions broken away, showing a top view of a railway hopper car.
Figure 2:
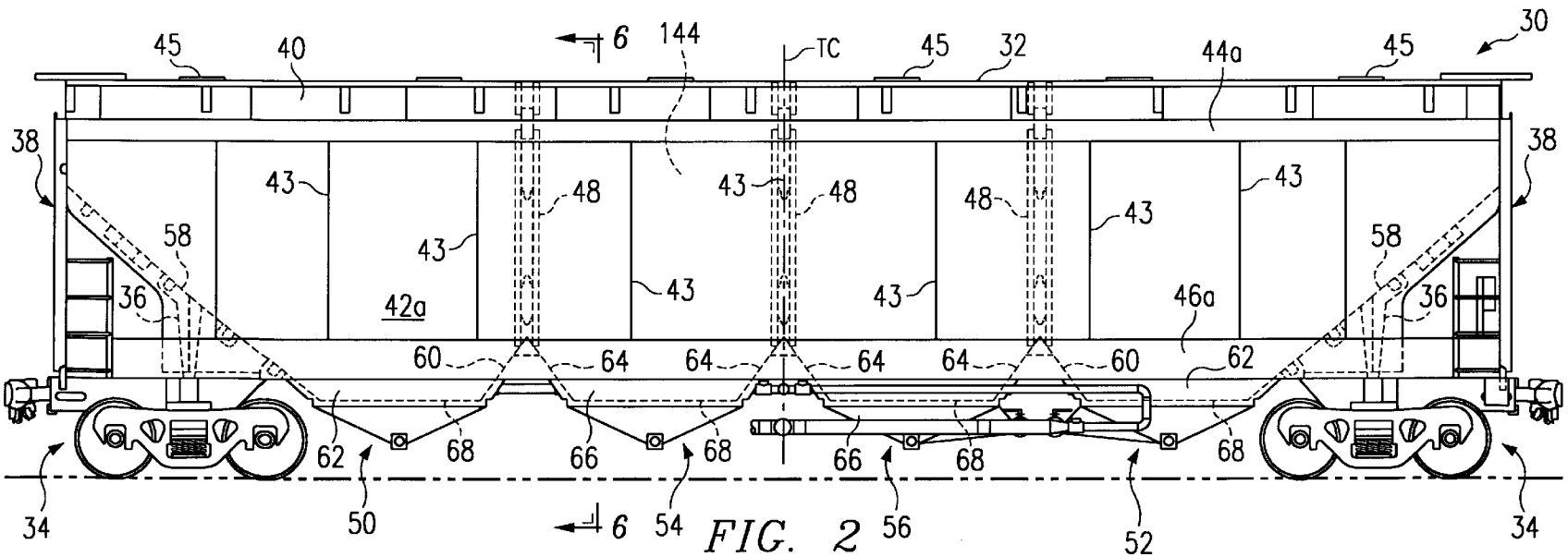
FIG. 2 is a schematic drawing, with portions broken away, showing a side view of the railway hopper car of FIG. 1.
Figure 3:
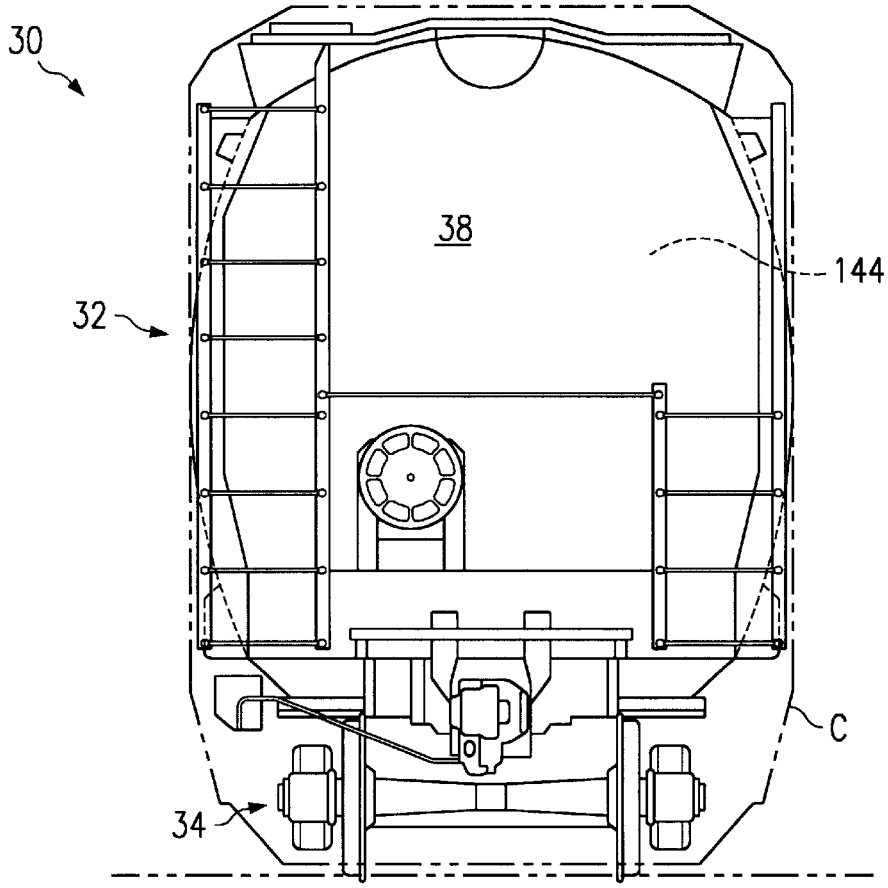
FIG. 3 is a schematic drawing, with portions broken away, showing an end view of the railway hopper car of FIG. 1.

A railway hopper car generally indicated by the reference numeral 30, is illustrated in FIGS. 1–3. For purpose of illustrating one embodiment of the present invention, car 30 is generally configured and dimensioned to conform to AAR Plate "C" requirements. Portions of these requirements appear in FIG. 3 in phantom lines and labeled "C". Car 30 includes a body 32 which is supported at each end on trucks 34 by bolsters 36 incorporated into end structures 38 of body 32. Body 32 is generally symmetrical about transverse centerline TC and longitudinal centerline LC of car 30. A top sheet 40 and side sheets 42*a* and 42*b* form a partially enclosed interior chamber 144. Side sheets 42*a* and 42*b* consist of curved plates butt-welded at junctures 43. Similarly, top sheet 40 may include curved plates butt-welded at junctures 47. Car 30 may be loaded with products via covered hatches 45 installed in top sheet 40. Channel-shaped top cords 44*a* and 44*b* and bottom cords 46*a* and 46*b* extend along each upper and lower edges of body 32. Crossridge frames 48 support top sheets 40 and side sheets 42*a* and 42*b*.

Side sheets 42*a* and 42*b* are curved elements with relatively large radii of approximately eleven feet in the illustrated embodiment. In another embodiment the radii may be approximately fifteen feet. Top sheets 40 have much smaller radii of curvature, relative to side sheets 42*a* and 42*b*. Top sheet 40 may have radius of curvature of approximately seven feet, in the illustrated embodiment. In another embodiment, the radius of curvature of top sheet 40 may be approximately nine feet. As a result of incorporating teachings of the present invention, railway hopper car 30 is generally wider at the lower one-half of body 32 than other railway hopper cars.

Figure 4:
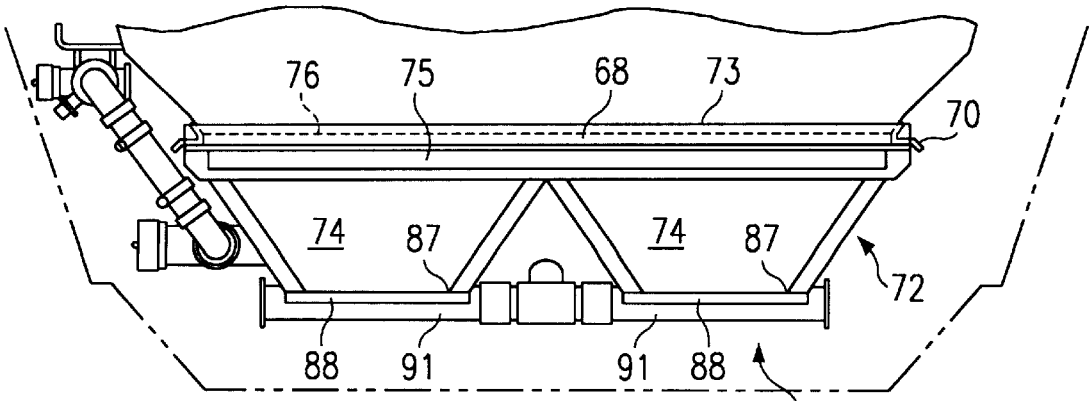
FIG. 4 is a schematic drawing, with portions broken away, showing a partial end view of an aerator tub assembly suitable for use with the railway hopper car of FIG. 1.

Railway hopper car 30 preferably has four hoppers 50, 52, 54 and 56. Front and rear hoppers 50 and 52 are formed in part by end slope plates 58 of car 30, end structures 38, transverse slope plates 60 and hopper side skirts 62. Center hoppers 54 and 56, which adjoin each other at transverse centerline TC, are formed in part by transverse slope plates 64 and side skirts 66. Each hopper 50, 52, 54, and 56 has a generally rectangular discharge opening 68 at its lower end. Each discharge openings 68 preferably has a similar size and shape defined in part by perimeter frame 70 (FIG. 4). Additional information regarding aerator tub assemblies and their associated piping and equipment suitable for use within the teachings of the present invention are described and shown in U.S. patent application Ser. No. 09/294,728, entitled *Pressure Discharge Railway Hopper Car.*

Referring to FIGS. 2 and 4, a respective aerator tub assembly 72 may be bolted to frame 70 of each hopper 50, 52, 54 and 56. Each aerator tub assembly 72 includes opening 73. Opening 73 is defined in part by a peripheral top frame 76, coextensive with discharge opening 68 of the respective hopper. Frame 76 may be fabricated from angle sections, the legs of which are preferably attached to frame 70. In another embodiment, aerator tub assembly 72 may be welded to frames 70.

Each aerator tub assembly 72 is generally symmetrical with respect to longitudinal centerline LC, and each aerator tub assembly 72 includes a plenum 75 and two aerator units 74 associated therewith. Aerator units 74 include outlet openings 87 which communicate with discharge conduits 91 through openings 88 in discharge conduits 91. Aerator tub assemblies 72 may be provided in various sizes and configurations. In the illustrated embodiment, each aerator tub assembly 72 is substantially identical.

A railway hopper car having a car body incorporating teachings of the present invention may be used with a wide variety of discharge systems and/or aerator tub assemblies. The present invention is not limited to use with the discharge system and/or aerator tub assemblies as shown in FIGS. 2, 4 and 5.

Figure 5:
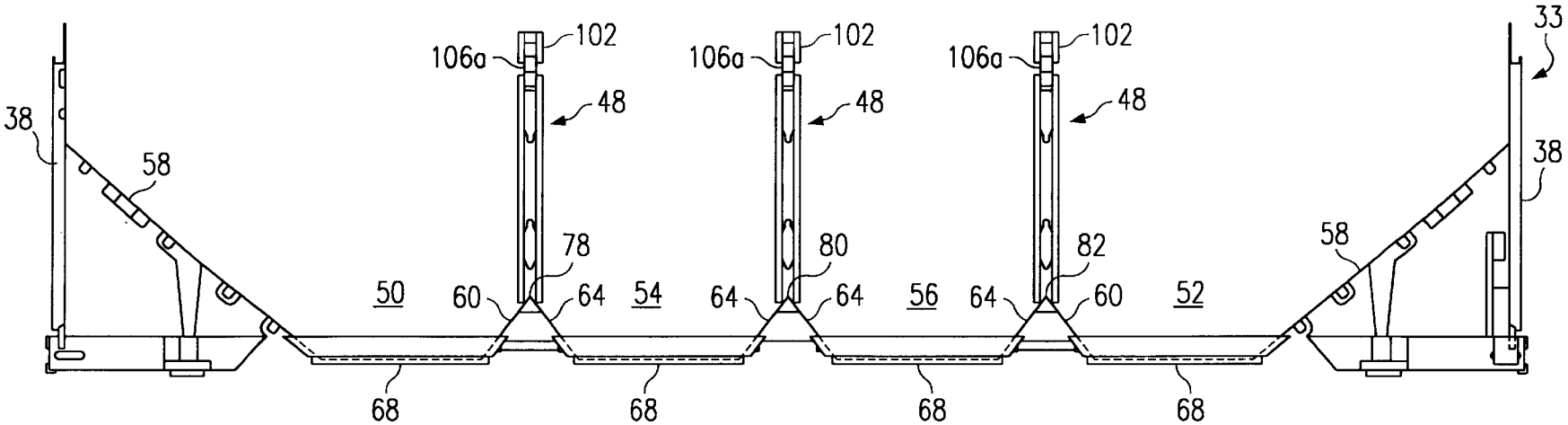
FIG. 5 is a schematic drawing, with portions broken away, showing a side elevational view illustrating the underframe arrangement of the car body of FIG. 1.

Referring to FIG. 5, underframe assembly 33 of body 32, is illustrated, and includes three inverted V-shaped slope sheet units 78, 80 and 82. Slope sheet units 78, 80 and 82 are formed, at least in part by their respective transverse slope plates 60 and 64, and extend generally parallel with transverse centerline TC. In combination with slope plates 58, slope sheet units 78, 80 and 82 help define respective hoppers 50, 52, 54 and 56. In the illustrated embodiment, downwardly diverging slope plates 58 and transverse slope plates 60 and 64 provide sufficient slope to urge products within railway hopper car 30 toward respective discharge openings 68.

Figure 6:
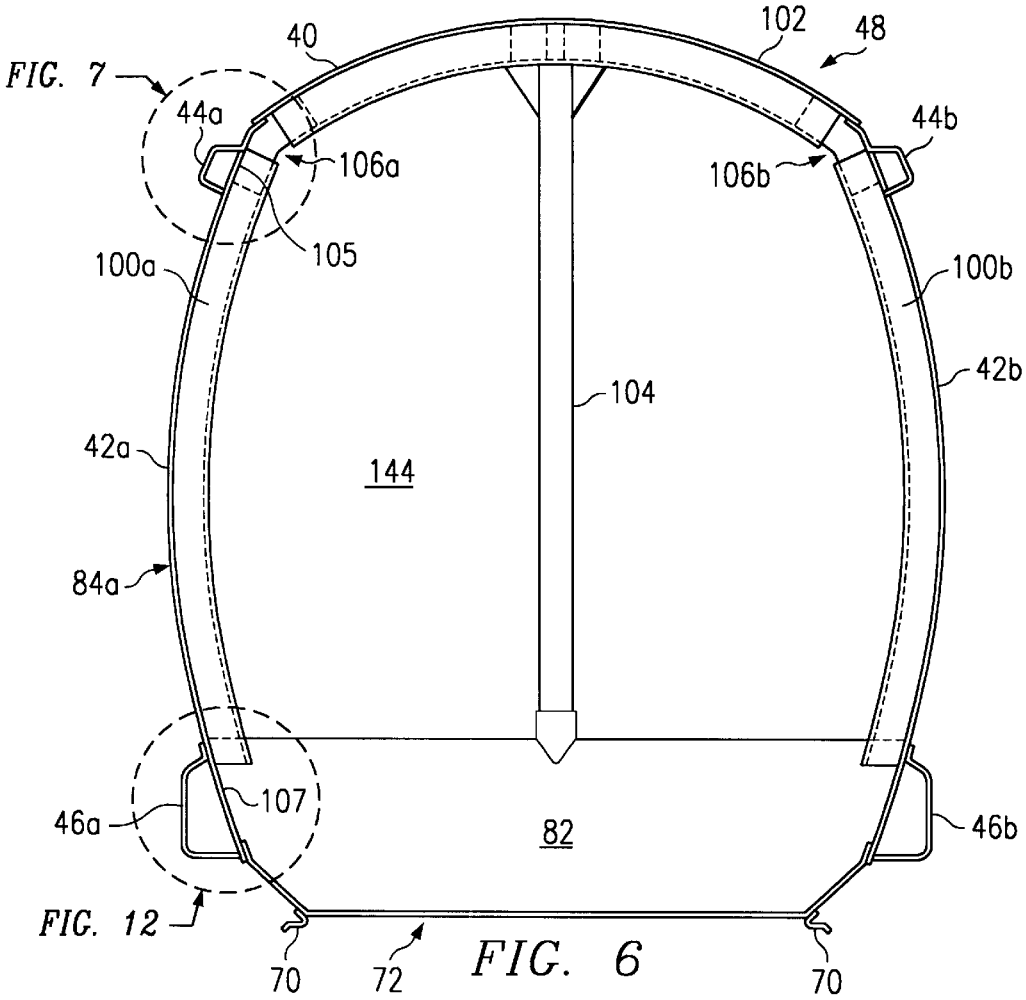
FIG. 6 is a schematic drawing, with portions broken away, showing a transverse cross-sectional view of the car body, taken along the lines 6—6 of FIG. 2, and is typical of cross-sections taken adjacent each of the three crossridge frames of the car body.

Slope sheet units 78, 80, and 82 are advantageous for pressurized hopper cars to supply additional strength during pressurization. Without the additional strength provided by slope sheet units 78, 80 and 82, body 32 might tend to deform toward a generally cylindrical configuration, having a generally circular cross section, when under pressure. Slope sheet units 78, 80 and 82 provide the strength necessary to maintain the desired oblong cross section such as shown in FIG. 6. An oblong configuration is desirable in order to maximize the volume of railway hopper car 30, within the confines of applicable AAR specifications, such as plate "C". This cross section provides volume capacity similar to a rectangular cross section with improved strength similar to a circular cross section.

FIG. 5 illustrates an early stage of assembly of car body 32. Three substantially identical crossridge frames 48 have been welded at their lower ends to each of the slope sheet units 78, 80 and 82. With reference to FIGS. 5 and 6, each crossridge frame 48 include outwardly (with respect to the interior of the car body) convexly curved side reinforcing ribs 100*a* and 100*b*, respectively, an outwardly convexly curved top reinforcing rib 102, and a vertical center column 104. Top reinforcing rib 102 and top sheet 40 are generally arcuate in end profile and have approximately equal radii of curvature.

Center column 104 extends essentially vertically from approximately the middle of top reinforcing rib 102 to a location approximately in the center of the corresponding slope sheet unit 78, 80 or, as in the illustrated embodiment, slope sheet unit 82. Each side reinforcing rib 100*a* and 100*b* is preferably connected to top reinforcing rib 102 by corner connectors 106*a* and 106*b*, respectively. In the illustrated embodiment, corner connectors 106*a* and 106*b* are metal castings. Corner connectors may be formed in accordance with teachings of the present invention by machining appropriately sized pieces of raw material, by forging or other suitable metal working techniques.

Figure 11:
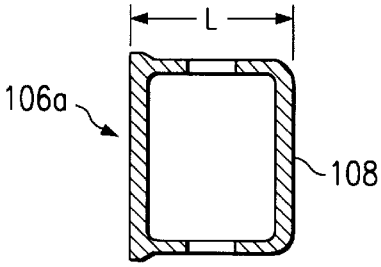
FIG. 11 is a schematic drawing, with portions broken away, showing an end cross-sectional view of the corner connector, taken along the lines 11—11 of FIG. 9.

The connection between top reinforcing rib 102, corner connector 106*a*, side reinforcing rib 100*a* and various associated components are illustrated in more detail in FIGS. 7–11. Side reinforcing ribs 100*a* and 100*b* and side sheets 42*a* and 42*b* are arcuate profile and have essentially equal radii. Each corner connector 106*a* has a side arm portion 108 engaging and fastened to an upper end portion 101*a* of the side reinforcing rib 100*a*, a top arm portion 110 engaging and fastened to an end portion 103 of the top reinforcing rib 102, and a juncture portion 112 joining side arm portion 108 to top arm portion 110. Side arm portion 108, top arm portion 110, upper end portion 101*a* and end portion 103 each having a generally tubular rectangular cross section. For example, the cross section of side arm portion 108 is illustrated in FIG. 11. Side arm portion 108 has a first leg L which measures approximately five inches, in the illustrated embodiment. Side arm portion 108 and top arm portion 110 form a generally obtuse angle. The internal profiles of side arm portion 108 and top arm portion 110 generally match the internal profiles of reinforcing ribs 100*a* and 102 such that each arm portion 108 and 110 "nest" in the outwardly facing end portions of 101*a* and 103 of reinforcing ribs 100*a* and 102, respectively. This provides additional strength and stability to each connection. In the illustrated embodiment side arm portion 108 and top arm portion 110 are slightly smaller than end portions 101*a* and 103, respectively, which facilitates the nesting of the components. In another embodiment, nesting of these components may be accomplished by slightly oversizing side arm portion 108 and top arm portion 110 with respect to end portions 101*a* and 103, to allow end portions 101*a* and 103 to nest within side arm portion 108 and top arm portion 110, respectively.

Prior to attachment of side sheets 42*a* and 42*b* to underframe assembly 33, top chords 44*a* and 44*b* and bottom chords 46*a* and 46*b* are welded to upper and lower edges 105 and 107 of each side sheet 42*a* and 42*b*. Top chord 44*a* includes a channel shaped portion 117 with a lower flange 116, and an upper leg portion 120. Top chord 44*a* is preferably welded continuously along weldment 114 at lower flange 116, spot-welded along a series of weld-site holes 118 in upper leg portion 120, and welded at a full length weldment 122 where the upper edge of side sheet 42*a* meets the inwardly facing side of leg portion 120.

Figure 12:
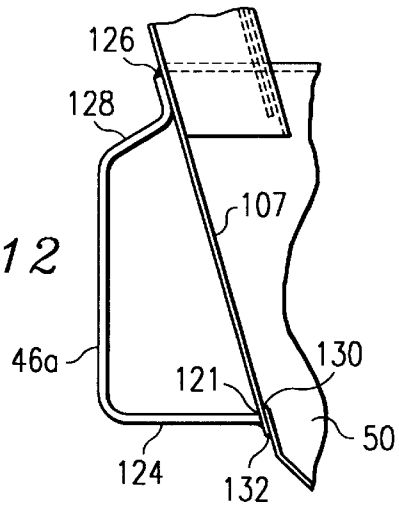
FIG. 12 is a schematic drawing, with portions broken away, showing a fragmentary detail end cross-sectional view of the corner juncture between the lower edge of a side sheet, a side reinforcing rib, a lower chord and a slope unit of the car body, as indicated by the circle marked "FIG. 12" in FIG. 6.

With reference to FIG. 12, bottom chord 46*a* is welded along weldment 121 to side sheet 42*a* along the entire length of the edge of a lower flange 124 and along weldment 126 at the end of an upper flange 128. Bottom chord 46*a* extends beyond the ends of the lower edge of side sheet 100 to the end structures 38 (see FIG. 2).

Side sheet assembly 84*a*, which includes side sheet 42*a* with top chord 44*a* and bottom chord 46*a* installed thereupon, is fastened to underframe assembly 33 with weldments 130 and 132 to each of the hoppers 50, 52, 54 and 56. For illustrative purposes, the attachment to hopper 50 only is shown in FIG. 12. The ends of the slope units 78, 80 and 82 and the end slope plates 58 are welded to side sheets 42*a* within car body 32. Each side sheet 42*a* is welded to side reinforcing ribs 100*a*. The upper leg portion 120 of each top chord 44*a* is welded to the juncture portion 112 of each of corner connectors 106*a* of crossridge frames 48 at a weldment 134.

Top sheet 40 includes multiple panels welded edge to edge and fastened to car body 30 by full length weldments 136 at each edge to top leg portion 120 of top chords 44*a*, by welds to both side flanges of the top reinforcing ribs 102 of the crossridge frames 48 and by welds to end structures 38.

Figure 7:
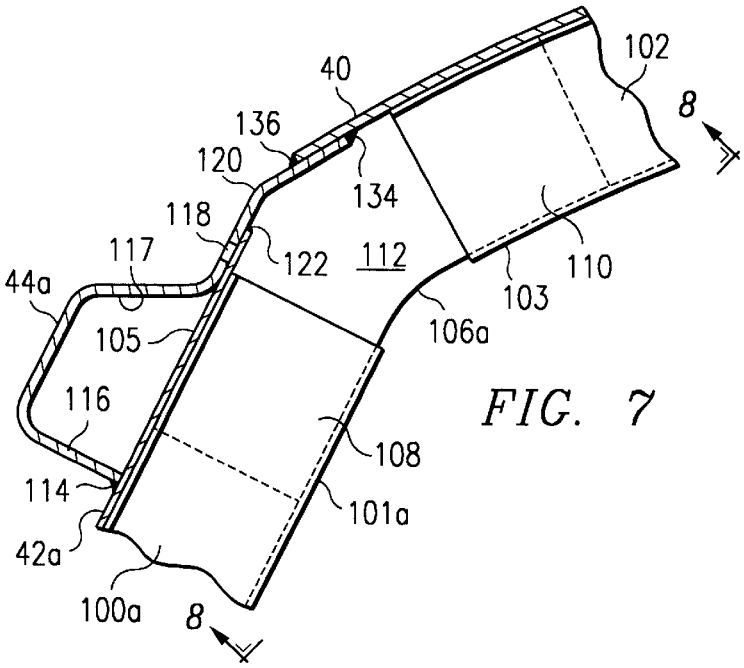
FIG. 7 is a schematic drawing, with portions broken away, showing a fragmentary detail end cross-sectional view of the corner juncture between a side section and the roof section of the car body, as indicated by the circle marked "FIG. 7" in FIG. 6.
Figure 8:
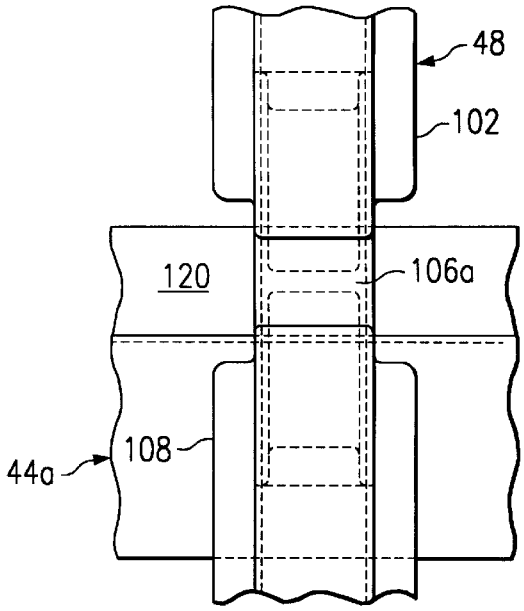
FIG. 8 is a schematic drawing, with portions broken away, illustrating a fragmentary elevational view of the corner juncture shown in FIG. 7, which is taken along view line 8—8 of FIG. 7.
Figure 9:
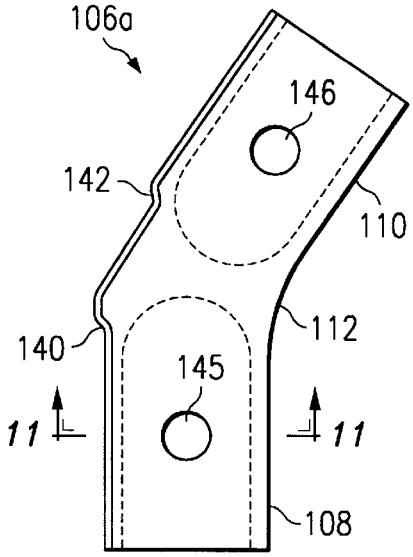
FIG. 9 is a schematic drawing, with portions broken away, showing a side elevational view of a corner connector that joins each side stiffener rib of each crossridge frame to the roof reinforcing rib.
Figure 10:
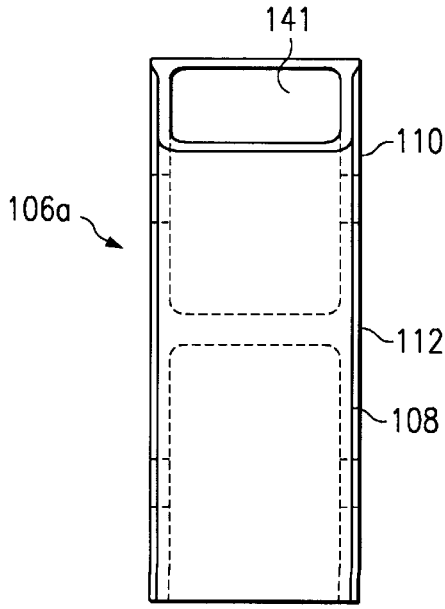
FIG. 10 is a schematic drawing, showing a rear elevational view (a view of the aspect that faces the interior of the car body) of the corner connector.

Referring to FIGS. 7 and 9, corner connector 106*a* has in the surface that faces outwardly a side offset 140 that receives the upper edge portion of side sheet 42*a* and enables upper leg portion 120 of top chord 44*a* to bear against juncture portion 112. A top offset 142 receives upper leg portion 120 of top chord 44*a* and allows top sheet 40 to engage, and bear against top arm portion 110 of corner connector 106*a*. Openings 145 and 146 are provided to accommodate the casting process. Tubular top arm portion 110 and side arm portion 108 are generally hollow components, with voids 141 provided to reduce the weight of corner connector 106*a*. Various sizes and configurations are available for corner connectors 106*a* and 106*b*. In the illustrated embodiment, corner connectors 106*a* and 106*b* have substantially the same configuration.

Other railway hopper cars, including grain and cement carrying cars have separate and distinct hopper units or sections. Car body 32, of the present invention has a generally uniform, open, large interior chamber 144 without segregating structures associated with other railway hopper cars. The illustrated embodiment of the present invention includes several smaller sections, or hoppers 50, 52, 54 and 56 located at the lower portion of car body 32. Hoppers 50, 52, 54 and 56 are substantially smaller than hoppers associated with other hopper cars. Otherwise, the interior of railway hopper car 30 is completely open, defining interior chamber 144.

The teachings of the present invention are not limited to pressure discharge railway hopper car applications. Any type of hopper car, grain carrying car, and/or any car unloaded by the force of gravity. The loss of strength associated with an oblong, or rectangular cross section, as opposed to a circular cross section, is offset at least partially by the configuration of components within railway hopper car 30, including slope sheet units 78, 80 and 82. Prior pressure discharge railway hopper cars often utilized cross sections tending toward circular, in order to take advantage of the associate increase in strength. This limited to carrying capacity, or volume of other railway hopper cars.

Railway hopper car 30 includes other elements that are well-known and require no description or illustration, including one or more safety vents, each with a pressure relief valve or a rupturable disc as desired, in the top of the car to prevent over-pressurization. A stand pipe, blow down valve, pressure relief valves and one or more inspection and cleanout ports, which are not shown in the drawings, may also be provided as part of the car. The blow down valve is used to depressurize the car after the unloading process has been completed. Advantageously, the blow down valve is installed on a pipe at the top of the end wall at the "A" end of the car and has a mechanical operating linkage that can be operated by a worker on the ground.

Although the present invention and its advantages have been described in detail, it should be understood that various changes, substitutions and alterations can be made herein without departing from the spirit and scope of the invention as defined by the following claims.

What is claimed is:

1. A large capacity car body for a pressure discharge railway hopper car having an interior chamber, comprising:

first and second end slope plates;

a plurality of intermediate slope sheet units, each having a generally inverted "V" shape;

the intermediate slope sheet units and the end slope plates forming sloping walls of a plurality of hoppers in a lower portion of the car body;

first and second side sheets forming sides of the car body and respectively attached to the intermediate slope sheet units;

each side sheet having a convex curvature, outwardly with respect to the interior chamber;

a top sheet forming a top of the car body and attached to end structures of the car body, the top sheet having a generally convex curvature with respect to the interior chamber;

a crossridge frame associated with each of the intermediate slope sheet units;

each crossridge frame having first and second side reinforcing ribs and a top reinforcing rib extending between upper ends of the respective side reinforcing ribs;

a corner connector joining the upper end of each side reinforcing rib to an end portion of the respective top reinforcing rib;

the first and second side sheets respectively attached to the first and second side reinforcing ribs; and the top sheet attached to the top reinforcing ribs, the top sheet and at least one side sheet being joined proximate the corner connector.

2. The car body of claim 1, further comprising:

the side reinforcing ribs and side sheets having a substantially arcuate profile and a first radius;

the top reinforcing rib and top sheet having a substantially arcuate profile and a second radius; and the first radius greater than the second radius.

3. The car body of claim 2, further comprising:

the first radius approximately equal to eleven feet and the second radius approximately equal to nine feet.

4. The car body of claim 3, further comprising:

the lateral extremities of the side sheets spaced apart by approximately ten feet, eight inches; and the top sheet having a span of approximately eight feet, five inches.

5. The car body of claim 1, wherein each crossridge frame further comprises a center column extending between and joined to the respective intermediate slope sheet unit and the respective top reinforcing rib.

6. The car body of claim 1, further comprising:

the side reinforcing ribs each having an upper end portion with a first generally tubular rectangular cross section;

the top reinforcing ribs having a pair of end portion each having a second generally tubular rectangular cross section;

a side arm portion of the corner connector having a third tubular rectangular cross section generally corresponding to and nested with the first rectangular cross section; and a top arm portion of the corner connector having a fourth generally tubular rectangular cross section, corresponding to and nested with the second rectangular cross section.

7. The car body of claim 1, wherein the corner connectors further comprise metal castings.

8. The car body of claim 1, further comprising:

a top chord member extending substantially coextensively with an upper edge portion of each side sheet;

the top chord member having a channel-shaped portion that overlies the associated side sheet and a lower flange portion attached to the side sheet; and the top chord member having a top leg portion extending from the channel-shaped portion to conform to and engage a juncture portion of the corner connector.

9. The car body of claim 8, further comprising an outer surface of each corner connector having a first offset surface between a side arm portion and a top arm portion which engages the side sheet;

the top leg portion of the top chord member overlapping the outer surface; and the outer surface of each corner connector having a second offset surface that engages the top leg portion of the top chord member.

10. The car body of claim 8, further comprising:

opposite edge portions of the top sheet overlapping at least a portion of the top leg portion of the top chord member; and a weldment coupling the top sheet and the top chord member.

11. The car body of claim 1, further comprising:

a bottom chord member extending substantially coextensively with a lower edge portion of each side sheet;

the bottom chord member having a channel shaped portion that overlies the side sheet and a lower leg portion attached to the side sheet; and the bottom chord member having a top flange portion attached to the side sheet.

12. The car body of claim 1, further comprising:

a center column extending substantially vertically from a middle portion of the top reinforcing rib to a corresponding slope sheet.

13. The car body of claim 1, further comprising:

a top chord member joining the top sheet and one of the side sheets.

14. A pressure discharge railway hopper car, comprising:

a plurality of trucks; and a plurality of bolsters disposed upon the trucks and supporting a large capacity car body, the car body comprising:

first and second end structures forming opposing ends of the car body;

first and second end slope plates;

a plurality of intermediate slope sheet units;

the end slope plates and slope sheet units forming a plurality of hoppers in a lower portion of the car body;

a respective crossridge frame associated with each of the intermediate slope sheet units;

each crossridge frame having upwardly extending side reinforcing ribs and a top reinforcing rib connecting respective upper portions of the side reinforcing ribs;

a corner connector coupling at least one of the side reinforcing ribs with an associated top reinforcing rib;

the side reinforcing ribs each attached to opposite sides of the slope sheet units;

a side sheet forming each side of the car body and attached to the side reinforcing ribs and the end structures;

a top sheet forming a top of the car body, the top sheet and at least one side sheet being joined proximate the corner connector;

the side reinforcing ribs and side sheets each having a first radius of curvature; and the top reinforcing rib and top sheet having a second radius of curvature which is less than the first radius of curvature.

15. The hopper car of claim 13, further comprising:

a center column associated with each crossridge frame extending vertically between and attached to the corresponding intermediate slope sheet unit and the corresponding top reinforcing rib.

16. The hopper car of claim 13, further comprising:

the side reinforcing ribs each having an upper end portion with a first generally tubular rectangular cross section;

the top reinforcing ribs having a pair of end portion each having a second generally tubular rectangular cross section;

a side arm portion of the corner connector having a third tubular rectangular cross section generally corresponding to and nested with the first rectangular cross section; and a top arm portion of the corner connector having a fourth generally tubular rectangular cross section, corresponding to and nested with the second rectangular cross section.

17. The hopper car of claim 13, further comprising:

a top chord member extending along an upper edge portion of each side sheet;

a lower flange of the top chord member welded to the side sheet; and an upper leg portion of the top chord generally conforming to the shape of and welded to a juncture portion of the corner connectors.

18. The hopper car of claim 17, further comprising:

a first offset surface on an outer surface of the corner connector between the side arm portion and the top arm portion generally flush with the side sheet and partially overlapped by the top leg portion of the top chord member; and a second offset surface generally flush with the top leg portion of the top chord member.

19. The hopper car of claim 13, further comprising:

a bottom chord member extending along a lower edge portion of each side sheet;

each bottom chord member having a lower flange portion welded to the side sheet; and a top flange portion of each bottom chord welded to the side sheet.

20. The hopper car of claim 14, wherein the corner connector has a side arm engaging and attached to a portion of the side reinforcing rib and a top arm engaging and attached to a portion of the top reinforcing rib;

the side arm and top arm having substantially planar surfaces facing outwardly with respect to the interior of the car body and forming an obtuse angle.

21. The hopper car of claim 14, further comprising:

a top chord member joining the top sheet and one of the side sheets.

* * * * *